United States Patent [19]

Gerhard

[11] Patent Number: 4,593,832

[45] Date of Patent: Jun. 10, 1986

[54] FREIGHT CONTAINER

[75] Inventor: Helmut Gerhard, Weitefeld, Fed. Rep. of Germany

[73] Assignee: Westerwalder Eisenwerk Gerhard GmbH, Fed. Rep. of Germany

[21] Appl. No.: 478,037

[22] Filed: Mar. 23, 1983

[30] Foreign Application Priority Data

Apr. 5, 1982 [DE] Fed. Rep. of Germany ..... 3212696

[51] Int. Cl.[4] ..... B65D 88/06; B65D 88/12

[52] U.S. Cl. ..... 220/1.5; 220/5 A; 220/69; 220/71; 220/72.1

[58] Field of Search ..... 220/71, 1.5, 5 A, 401, 220/72.1, 70.1, 69; 410/45, 44

[56] References Cited

U.S. PATENT DOCUMENTS

| | | | |
|---|---|---|---|
| 2,477,831 | 8/1949 | Schmitz, Jr. | 220/71 X |
| 3,746,375 | 7/1973 | Funk | 285/286 |
| 3,841,275 | 10/1974 | Bisbee et al. | 410/45 X |
| 3,971,491 | 7/1976 | Mowatt-Larssen et al. | 410/44 X |
| 4,065,022 | 12/1977 | Cainaud | 220/71 |
| 4,307,812 | 12/1981 | Gerhard | 220/71 X |
| 4,314,677 | 2/1982 | Sareen | 138/155 X |
| 4,381,062 | 4/1983 | Taquoi | 220/1.5 X |
| 4,416,384 | 11/1983 | Bjurling | 220/71 X |
| 4,421,243 | 12/1983 | Taquoi | 220/1.5 |

FOREIGN PATENT DOCUMENTS

| | | | |
|---|---|---|---|
| 1271325 | 6/1968 | Fed. Rep. of Germany | 410/45 |
| 1468665 | 3/1977 | United Kingdom . | |

*Primary Examiner*—Allan N. Shoap

*Attorney, Agent, or Firm*—Barnes & Thornburg

[57] ABSTRACT

In a freight container the tank is joined via saddle means to end frames which are provided with the standardized corner fittings which are normally used in container design and determine the outer dimensions of the container. Each saddle means in its simplest form consists of a cylindrical end ring welded to the relatively less curved spherical main portion of the tank end portion surrounded by the highly curved knuckle zone, and of a saddle ring of L-shaped cross-section having its radially extending flange secured to the end frame and/or diagonal struts thereof and its second flange extending in tank axial direction welded to the end ring. This structure permits a strong connection between the tank and the end frame, while the loads transmitted by the tank are almost completely directly introduced into the corner areas of the end frame. At the same time it permits the "breathing motions" occurring on account of temperature and pressure variations in the knuckle zone of the tank end portion. The relatively large angle at which the end ring joins the tank end portion avoids recesses which would not be readily accessible and therefore be susceptible to corrosion.

22 Claims, 12 Drawing Figures

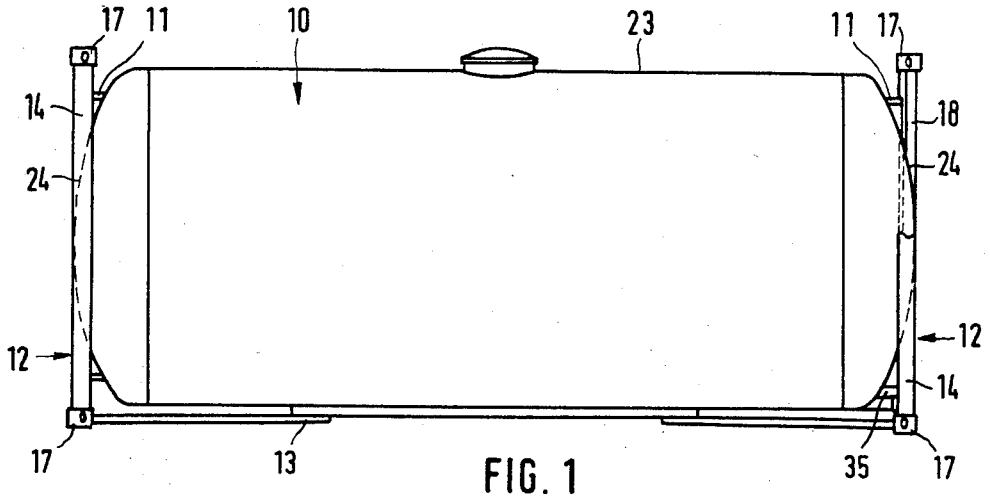
FIG. 1
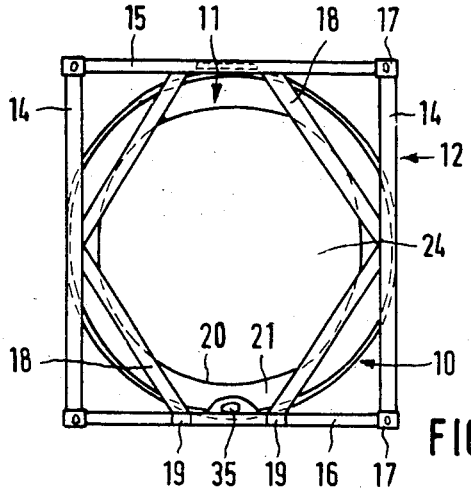
FIG. 2
FIG. 4
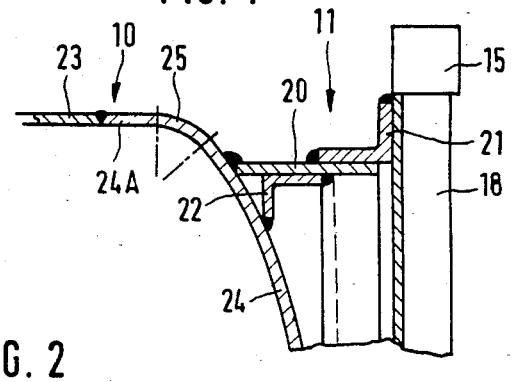
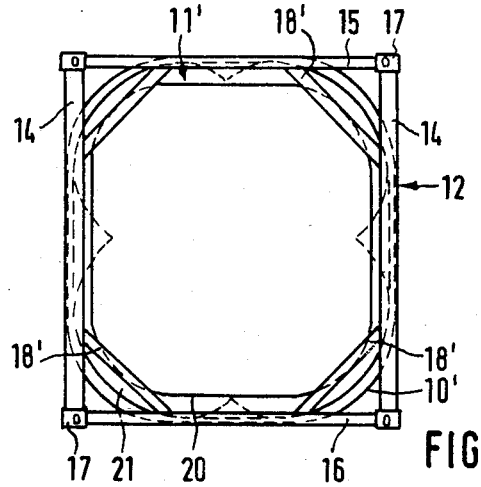
FIG. 3
FIG. 5
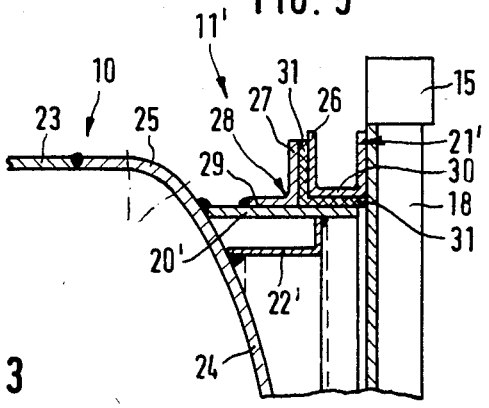

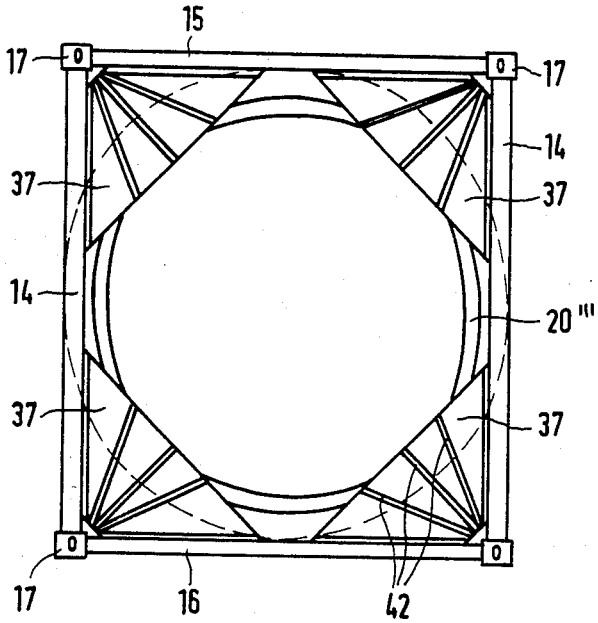
FIG. 9
FIG. 10
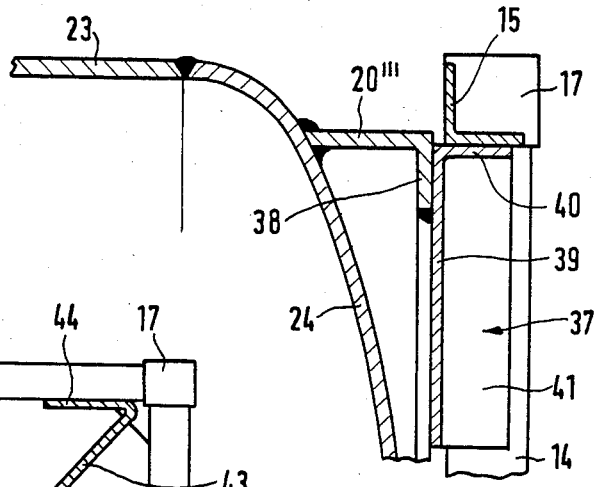
FIG. 11
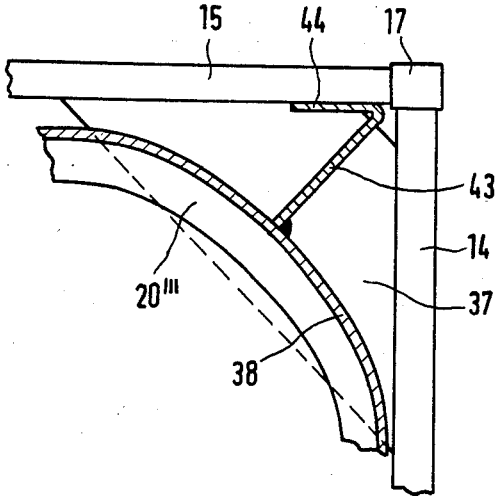

FREIGHT CONTAINER

The invention relates to a freight container.

German Offenlegungsschrift No. 2,828,349 discloses a freight container in which the tank is joined in the region of its two end faces through four saddle members to a respective end frame, wherein each saddle member is shaped as a shell element formed from a blank, one edge thereof being welded to a reinforcing ring surrounding the tank and opposite edges being welded to transverse and vertical beams of the respective end frame.

The shell-type saddles used in the known cargo container basically offer the advantage that they introduce the loads occurring on the tank directly into the corners of the end frames where the corner fittings provided for engagement with hoisting or lashing elements are disposed, while at the same time major peak stresses at the tank itself are avoided. As compared to earlier designs, in which cylindrical tanks are completely surrounded by a box-like frame, the known cargo container structure where this frame is reduced merely to the two end members—which may, if desired, be joined to each other by a bottom structure—results in a considerable saving of material and weight.

The reinforcing rings which are made of double-T, U- or top-hat section material and to which the saddle members are welded, have a considerable rigidity. Therefore they do not follow certain circularity errors of the tank shell as are caused by heating during welding, especially during welding of the reinforcing rings to the tank. Moreover, the reinforcing rings have to have a predetermined minimum inner diameter so that they may be fitted onto and over the tank in the finished condition together with the saddle members already welded thereto. Furthermore, the weld between the tank bottom or end portion, which normally retains its rated diameter, and the tank outer wall contracts due to being heated. But it is just in the region of this weld where the reinforcing ring is secured to which the saddle members are mounted. Actually, all these facts result in considerable welding gaps and consequently in the necessity of backing the tank outer wall in the region of the reinforcing rings, which is an additional and very time-consuming operation.

Since the reinforcing rings must not exceed the standardized container width even in the girth area, their own radial height results in a limitation of the tank diameter. In the case of thin-walled tanks which require reinforcing rings in order to be vacuum resistant and indent-proof, this has to be put up with. But in the case of large-volume and high-pressure resistant tanks whose wall thickness is sufficient to resist the required overpressures without any additional measures, the decrease in volume caused by the rings is undesirable.

It is an object of the invention to provide a cargo container of the above-mentioned species which retains the basic advantages of a mere end-face connection to end frames while at the same time permitting obtaining a maximum shell diameter, labour-saving manufacture, and an even more reliable connection between tank and end frames.

This object is met by a freight container according to a preferred embodiment of the present invention, which comprises (a) a cylindrical tank shell and end portions each joined to the tank shell with a knuckle zone of a radius which is smaller than the radius of the curvature of curvature of each bottom (b) two end frames defining the overall dimensions of the container, each end frame having upper and lower transverse beams, vertical supports and corner fittings, and (c) means joining the tank to each end frame and including (c1) end rings welded to a part of the said tank end portions surrounded by said knuckle zone, and (c2) saddle structures each having a first flange joined to a portion of said end ring and a second flange extending substantially perpendicularly to said first flange and being joined to said respective end frame.

In the above defined structure, the end ring is welded to that portion of the curved tank end portions which will substantially retain its shape even in case of mechanical or thermal strains. Furthermore this part of the tank end portions is very close to the end frame so that the end rings and saddle structures require only little axial length, thus provide high strength. The ring shape not only contributes to the stability of the joint between tank and end frame but also means that the loads from the tank are uniformly accommodated over the entire circumference thereof without any peak stresses liable to result in fatigue. The saddle structures joined to the end ring permit a direct introduction of the loads into the rigid end frame supports and beams and, via the same, into the corners of the end frames. The combined use of end rings welded to the tank and saddle structures secured to the end frames furthermore permits the compensation of unavoidable longitudinal tolerances during the final assembly step, so that the standardized lengths between the corner fittings of the two end frames may be observed with a high degree of accuracy in the finished container.

From German Offenlegungsschrift No. 2,325,058, it has been known to join a tank to the end members of a frame via an end ring welded to the tank bottom and a bellows member connected thereto. But the structure described therein relates to heated tanks and in particular to the compensation of the different thermal behaviour of frame and tank. Since the known saddle structures are unsuitable for providing a connection between tank and frame which even in the case of mechanical shocks acting especially in axial direction is sufficiently rigid yet fatigue-resistant, it is necessary in the above case to design the frame as a box-like frame surrounding the entire tank and to support and fix the tank within said frame by means of a central saddle. In this structure the load transmission from the tank to the frame corners, where the loads may be accommodated by the base or by hoisting or lashing elements, takes place over considerable distances and is therefore extremely detrimental in static respect.

Further serious drawbacks of this prior-art structure reside in that the end structures are welded to the sharply curved flanged zone of the tank end portion, which in the case of load variations will undergo dimensional changes. These "breathing" motions result in undesirable strains acting on the welds. Furthermore, the end structures are joined to the tank end portion so as to form a very acute gap which is not accessible to cleaning, so that uncontrolled sources of corrosion may develop therein.

In a preferred embodiment of the invention, each saddle structure includes a saddle ring of L-shaped cross-section having a first flange extending in the axial direction of the tank and a second flange extending radially outwardly. This saddle ring may be secured to diagonal struts or plane elements bridging the corners of the respective end frame. The saddle ring and the struts may have a U-shaped profile. A particularly high rigidity of the connection between the tank and end frames is thus achieved while, at the same time, the central region of each end frame remains free so that the curved tank bottoms may project into this free space, thereby permitting the entire tank to have a maximum length within the limits of the frame.

In a modification, the diagonal struts each interconnect a center of a vertical support of the respective end frame with an inner bearing location of a lower transverse beam of the frame. This achieves a direct introduction of loads from the tank via the saddle structures into those locations which, in accordance with the applicable international standards, may be used as supporting locations in addition to the frame corners.

In a further embodiment, each end ring is joined, via diagonally extending elements, directly to the corner fittings of the respective end frame. In addition to providing for a direct introduction of the loads into the container corners, this embodiment offers the advantage that supporting elements for incorrectly stacked containers are formed.

In another advantageous embodiment, it becomes possible separately to pre-fabricate the tank with the end rings welded thereto, on the one hand, and the end frames with the saddle rings welded thereto, on the other hand, and then to join these three main components of the container with high stability by means of additional fitting rings. Also in this embodiment, the longitudinal tolerances may be accurately observed. Insulating members sandwiched between mutually facing flanges of the saddle and fitting rings and of the saddle and end rings may be provided if insulation between the tank and end frames is desirable or necessary.

In another preferred embodiment, each saddle ring is a radially inwardly open U-section partial ring secured to the lower half of the respective end frame, and the respective end ring engages into the saddle partial ring with a radially outwardly extending profiled element. This permits a particularly easy assembly of the freight container by placing the tank with the end rings welded thereto into the two troughs formed by the partial rings, and subsequently anchoring the tank at an upper location of each end frame.

In a further embodiment, each end ring has an L-shaped cross-section with an axially extending flange welded to the respective tank end portion and a radially extending flange, wherein each saddle structure includes four corner elements each of which has a first plane parallel and joined to the radially extending flange of the end ring and second and third planes extending perpendicularly to each other and to the first plane and being joined to respcctive parallel faces of the vertical support and transverse beams of each end frame. In this embodiment, tolerances in the axial direction are taken care of during assembly of the container by a relative movement between the corner elements and the end frames. These corner elements thus provide the function of both the saddle ring and the diagonal struts provided in the above embodiments.

Rigidity of the design is increased by a reinforcing web which may be welded to the first plane of the corner element so as to extend radially from the respective corner of the end frame. The radially inner end of the web may be further welded to the end ring.

The radially outer and inner edges of each end ring may be welded directly to the respective tank end portion. This concept is preferred when the end ring has sufficient wall thickness. Otherwise, it is preferred to provide a support ring of L-shaped cross-section, having a first flange welded to the tank end portion inside or outside the end ring, and a second flange welded to the end ring. Accordingly, the two welds provided at the tank end portion have a greater spacing from each other. In both cases, the formation of gusset portions, which are difficult to access and are therefore susceptible to corrosion, will be avoided.

The connection between the tank and the end frames in accordance with the present invention is applicable not only to circular-cylindrical tanks but also to tanks of different cross-section.

Preferred embodiments of the invention will be described in detail below with reference to the drawings, in which:

FIG. 1 is a side view of a freight container;

FIG. 2 is an end view of the container shown in FIG. 1;

FIG. 3 is an end view of another embodiment of a freight container;

FIG. 4 is an enlarged view showing the right-hand upper corner of the container shown in FIG. 1;

FIGS. 5 and 6 are views of other embodiments, which are similar to FIG. 4;

FIG. 9 is an end view of a further embodiment of a freight container;

FIG. 10 is an enlarged sectional view similar to FIG. 4 showing a detail of the embodiment of FIG. 9; and FIG. 11 is a sectional view showing the end-ring and saddle structure of a modification of the embodiment shown in FIGS. 9 and 10.

Figure 6:
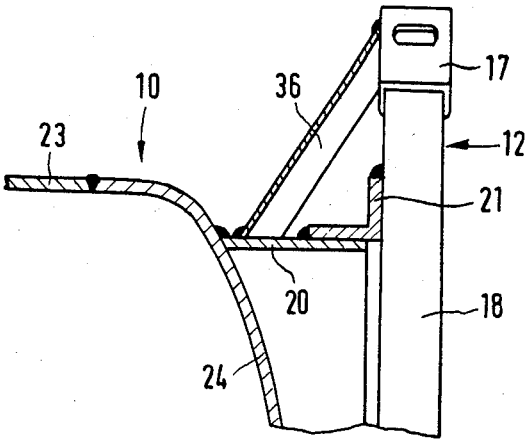

The freight container shown in FIG. 1 comprises a cylindrical tank 10 having either circular or non-circular cross-section, each of the two ends of which is joined to an end frame 12 by means of a saddle assembly generally referenced 11. As is apparent from FIG. 1, the two end frames may be interconnected through a bottom assembly 13, which is constituted, e.g. as shown similarly in German Offenlegungsschrift No. 2,828,349, by a central keel spar and four diagonal spars connecting the two ends of said keel spar to the respective two lower corners of the end frames 12. In another modification the two end frames 12 may also be interconnected by means of two longitudinal spars interconnecting the respective lower corners or by means of four longitudinal spars respectively interconnecting all four corners, and/or by means of rubbing beams disposed along the sides of the tank 10. Provided the tank has sufficient inherent stability it is basically also possible to do without any connecting elements between the end frames 12 other than the saddle assemblies 11.

According to FIG. 2 each end frame 12 consists of two vertical supports 14, an upper transverse beam 15 and a lower transverse beam 16. The corners of the end frame 12 which are formed by the supports and beams 14 to 16 are each provided with a standard corner fitting 17. The spacings between the corner fittings 17 with respect to width, height and also length of the container meet the internationally standardized dimensions. Diagonal struts 18 extend from the centres of the two vertical supports 14 and terminate at the lower beam 16 (and symmetrically therewith at the upper beam 15) at locations 19, which are also—in accordance with present international standards—allowed as further load bearing locations. The diagonal struts 18 are made of U-section beams and are welded—as indicated in FIG. 5—to the vertical supports and transverse beams of the end frame 12 such that the open side of the U-section faces outwardly. The saddle assembly is welded with an outwardly facing flange surface to the diagonal struts 18.

The end frame shown in FIG. 3 consists substantially of the same structural elements as the end frame shown in FIG. 2, but it is adapted to a part-cylindrical four-shell tank cross-section. It is assumed that the tank outer wall is composed of four cylinder shells of part-circular cross-section, which enable an improved utilization of the container cross-section as defined by the four corner fittings 17. The saddle structure 11', which is matched to the cross-sectional shape of the tank 10', is joined at its corner portions to diagonal struts 18' which are positioned farther outwardly towards the corners of the end frame and thus ensure an even more direct load transmission from the tank into the corner fittings 17.

In the embodiment shown in FIG. 4 the saddle assembly comprises an end ring 20, a saddle ring 21, and a support ring 22. Furthermore it is apparent from FIG. 4 that the tank 10 is constructed of a tank shell 23 and a tank end portion 24 welded thereto, the major portion of the tank end portion being curved with a relatively large radius, whereas at the transition to the tank outer wall 23 it is provided with a sharply curved knuckle zone 25.

The end ring 20 is joined to the main portion of the tank bottom surrounded by the knuckle zone 25 by an external weld. When the end ring 20 has a sufficient wall thickness it is possible, because of the then relatively large spacing from said outer weld, to provide a further weld on the inside of the end ring 20 so as to additionally join it to the tank end portion 24. This inner weld need not be continuous. Especially it may be absent in the upper region, because no liquid will collect there anyway. In any case the inner weld can be provided without any difficulties, because the end ring is joined to the relatively slightly curved main portion of the tank bottom 24 and therefore includes a correspondingly large angle therewith.

As is shown in FIG. 4, however, instead of the inner weld the support ring 22 may be provided, which with its flange extending in axial direction of the tank outer wall 23 is welded to the end ring 20 and with its radially inwardly directed flange is welded to the tank end portion 24 at a location which in any case is sufficiently distant from the outer weld between end ring and tank end portion. The same effect may also be achieved when the support ring 22' is of inverted design as shown in FIG. 5. In any case an outwardly sealed corrosion-proof chamber will be formed in the internal angle between end ring 20 and tank bottom 24.

Figure 12:
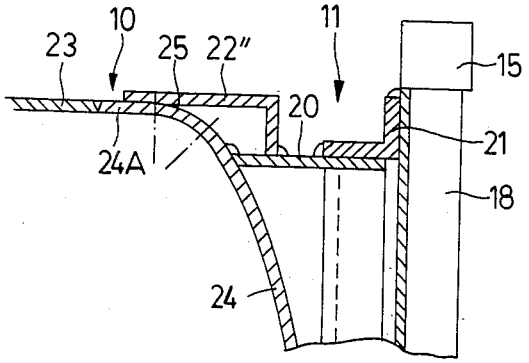
FIG. 12 is an enlarged view showing another embodiment of the right-hand upper corner of the container shown in FIG. 1.

As indicated in FIG. 12, it is possible to provide, instead of the internally disposed support ring 22 of FIG. 4, a support ring 22" surrounding the end ring, which support ring is welded with its radially inwardly directed flange to the end ring 20 and with its axially extending flange to the cylindrical rim 24A of the end portion 24, which rim is between the tank outer wall 23 and the knuckle zone 25. In this case the support ring 22" must be so constructed and dimensioned that it will follow the "breathing" motions of the flanged zone 25.

As is further apparent from FIG. 4, the saddle ring 21 includes a radially outwardly projecting flange by means of which it is welded to the sides of the vertical supports 14 and the diagonal struts 18 of the end frame 12 and possibly also to the transverse beams 15, 16 thereof, and further includes an axially extending flange with which it rests on the end ring 20 and is welded thereto. For the saddle ring 21 to be able to engage both the vertical supports 14 and also the diagonal struts 18 it is important that the surfaces of these parts 14, 18 facing the saddle ring 21 are coplanar.

The inherently rigid ring shape of the end, saddle, and support rings forming the saddle structure, and the slight spacing between the main portion of the end portion 24 and the end frame 12 ensure a high rigidity of the joint between tank and end frame. For a further stiffening of the saddle structure the end ring may also be designed as a ring having an L-section by including, for instance, an inwardly extending flange at its outer end. Likewise, the saddle ring 21 and also the support ring 22 may have U-shaped cross-section.

In the modification shown in FIG. 5 the saddle ring 21' welded to the sides of the end frame 12 and the diagonal struts 18 thereof is provided with an outwardly open U-section. The radial flange 26 of this saddle ring 21', which flange faces the tank 10, is joined to the adjacent radial flange 27 of a fitting ring 28 whose axially extending flange 29 is secured to the end ring 20'. An insulating member 31 is sandwiched respectively between the two flanges 26 and 27 and between the central web 30 and the part of the end ring 20' opposed thereto, which insulating member may comprise one or several layers and may be either elastic or non-elastic. This embodiment is especially suitable for heated tanks.

In this case the joint via the insulating member between the flanges 26 and 27 of the two rings 21' and 28 and between the saddle ring 21' and the end ring 20' is made by means of bolts. In order to increase the rigidity of the overall saddle assembly, the support ring 22' according to FIG. 5 is of such axial length that it supports the end ring 20' over that portion where the saddle ring 21' engages the end ring 20'.

In case an insulation is of no importance, the embodiment shown in FIG. 5 may also be used without the insulating member 31. Then it is also possible to weld the various rings to each other instead of providing bolted connections. In either case the saddle ring 21' may be joined to the diagonal struts 18 of the end frame 12 by welding instead of by the bolted connection shown in FIG. 5.

In accordance with FIG. 6, which is a diagonal section in a plane including the tank axis, the end ring 20 may furthermore be connected to the four corner fittings 17 of the respective end frame 12 via diagonally extending profiled elements 36. These profiled elements 36, which may e.g. have U-section open towards the end frame 12, cause a direct load transmission from the tank 10 to the corner fittings 17 and at the same time form support elements for incorrectly placed stacked containers.

In assembling the container, the end ring 20 or 20' is first welded to the tank end portion 24. If a support ring 22 or 22′ is provided, the same will then be inserted into the end ring and welded to the tank end portion and to the end ring. The girth welds, if required, can be made and controlled in a highly economic way on automatic girth welders. The thus completed bottoms are then welded to the prefabricated tank shell. The previously arranged end and support rings serve as fitting aids. Thereupon the saddle ring 21′ and the fitting ring 28, respectively, and—possibly with the insulating member 31 sandwiched therebetween—are pushed onto the end ring 20 or 20′, and the thus formed assembly is inserted between the end frames 12. Now the saddle rings 21 or 21′ are joined by welding or bolting to the sides of the end frames 12 and/or the diagonal struts 18 thereof, and finally the saddle ring 21 or the fitting ring 28, respectively, is welded to the end ring 20 or 20′. Prior to the forming of this last weld, which effects the final joint between tank and end frame, the tank and the end frame are aligned with one another in such a way that the prescribed longitudinal tolerances for the entire container are observed while at the same time stresses are avoided.

Figure 7:
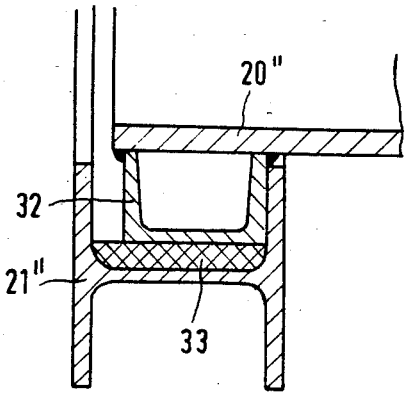
FIG. 7 is a further modification represented by a left-hand lower corner portion of a freight container, as viewed in FIG. 1.
Figure 8:
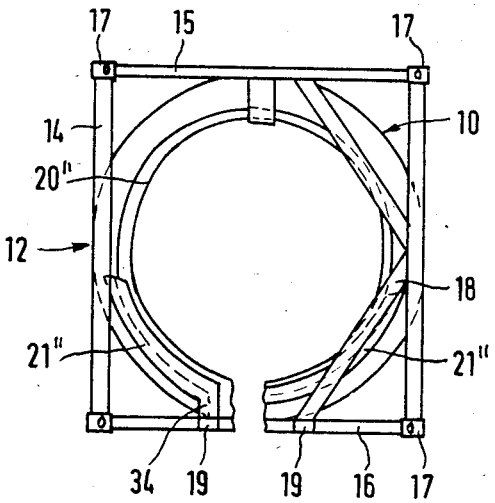
FIG. 8 is an end view of a freight container according to the modification shown in FIG. 7.

In the embodiment shown in FIGS. 7 and 8 the saddle ring 21″ secured to the end frame 12 is a half-ring having H-section or at least U-section open towards the inside and the top. Thus the ring 21″ forms a trough-shaped member into which the end ring 20 engages with a profiled ring 32 welded thereto. It is also possible to provide the end ring 20″—instead of with the section ring 32 shown in FIG. 7—with an outwardly projecting flange engaging into the profile of the saddle ring 21″. As shown in FIG. 7, an elastic or non-elastic insulating member 33 formed of one or several layers may be sandwiched between the profiled ring 32 and the trough formed by the saddle ring 21″, which is especially suitable in the case of heated tanks.

As is apparent from the right-hand part of FIG. 8, the saddle half-ring 21″ may be secured—similar to FIG. 2—either on or in the supports 14 and struts 18 of the end frame 12. According to the alternative shown in the left-hand part of FIG. 8, however, it is also possible to provide two separate saddle ring members each extending over an angle of only about 60°, wherein the outer end of each is directly welded to the respective corner support 14 of the end frame 12 and the bottom end of each is welded via a short vertical support 34 to the respective location 19 of the bottom cross spar 16. In that case the saddle ring members may take over the static function of the diagonal struts.

The upper portion of the profiled ring 32 (or, respectively, the flange of the end ring 20″ provided instead thereof) is fixed in axial and radial direction relative to the end frame 12 by anchoring means indicated in FIG. 8. Instead of such anchoring means it is also possible, after placing the tank with the profiled ring 32 into the saddle half-ring 21″, to place a further saddle half-ring onto the upwardly exposed part of the profiled ring 32 and to bolt the same to the end frame 12. A further alternative resides in the fixing of the tank relative to the saddle half-ring 21″ by means of straps and/or anchor bolts.

As already mentioned above, it is expedient to make the end ring 20 or 20′ or 20″, respectively, as large as possible so as to minimize the distance to the container corners through which the loads have to be transmitted from the tank. On the other hand, the diameter of the end ring is limited by the fact that the end ring is welded within the flanged zone 25. A discharge valve 35 possibly disposed at the lowermost location of the tank bottom may be accessible via a flattened portion or recess of the end ring provided at that location.

The diagonal struts shown in FIGS. 2 and 3 are advantageous because they leave the centre of the end frame free, into which centre the tank bottom may project with its middle portion which extends farthest to the outside. This modification therefore permits optimum utilization of space in container longitudinal direction. Another possibility not shown in the drawing resides in the provision of two crossing and diagonally extending struts, which join opposite corner fittings and offer the advantage that the loads transmitted from the tank via the saddle structure are directly introduced into the corner fittings 17.

In the embodiment shown in FIGS. 9 and 10, the saddle assembly comprises an end ring 20‴ and four triangular corner elements 37. The end ring 20‴ has an L-shaped cross-section, its inwardly extending flange 38 being welded to the vertical planes 39 of the four corner elements 37. Each corner element 37 has two further planes or flanges 40 and 41 which extend perpendicularly to each other and to the plane 39 and are welded to those of the vertical supports 14 and transverse beams 15, 16 which define the respective corner of the end frame 12. The joints between the planes 39 to 41 of the corner element 37 on the one hand the flange 38 of the end ring 20‴ and the end frame elements 14 to 16 on the one hand may be reinforced by slot welds.

As shown in FIG. 10, the corner element 37 may be so oriented that its planes 40 and 41 face away from the tank bottom 24. Reinforcing webs may be provided on the same side of the plane 39 to which the planes 40 and 41 extend, and these webs 42 may be arranged so as to fan out from the corner of the end frame, as shown in FIG. 9. As is further indicated in FIG. 9, the very corner portion of the corner elements 37 may be omitted to ensure proper fitting of the corner element into the corner region of the end frame.

In the modification of FIG. 11, which is a sectional view cutting through the end ring 20‴ and looking outwardly from the tank, a reinforcing web is provided on the side of the plane 42 facing towards the tank. The web 39 extends diagonally and has its inner end welded to the end ring 20‴.

The outer end of the web 43 may be bent to form a small horizontal platform 44 for receiving a corner fitting 17 of an upper container incorrectly stacked onto the container part of which is shown in FIG. 11.

In assembling the container shown in the embodiments of FIGS. 9 to 11, the end rings 20‴ are welded to the two tank end portions 24, and four corner elements 37 are welded to each end ring 20‴. One end frame 12 is then joined at one end of the thus formed assembly by welding the planes 40, 41 of the four corner elements 37 to the respective vertical supports 14 and transverse beams 15, 16 of that end frame. The other end frame is then moved relatively to the corner elements 37 provided at the other end of the tank into the proper axial distance from the first frame and then joined into the tank in the same manner as the first frame.

I claim:

1. A freight container comprising:

(a) a cylindrical tank shell which defines a longitudinal axis and tank end portions each joined to the tank shell with a knuckle zone of a radius of curvature which is smaller than the radius of curvature of each tank end portion, (b) two end frames defining the overall dimensions of the container, each end frame having upper and lower transverse beams, vertical supports and corner fittings, and (c) means joining the tank to each end frame and including (c1) end rings each welded to a part of the respective tank end portions surrounded by and in close proximity to said knuckle zone, and (c2) saddle structures each having a first flange joined to a portion of said end ring and a second flange extending substantially perpendicularly to said first flange and being joined to said respective end frame, said saddle structures being spaced from the cylindrical shell and the respective tank end portions and engaging the respective end rings at a location disposed inside of the maximum diameter of the cylindrical shell.

2. The container of claim 1, wherein each said saddle structure includes a saddle ring of L-shaped cross-section, said first flange extending in the axial direction of the tank and said second flange extending radially outwardly.

3. The container of claim 2, wherein said saddle ring is secured to diagonal struts which bridge the corners of the respective end frame.

4. The container of claim 3, wherein each diagonal strut connects a center of the respective vertical supports of the respective end frames to load bearing locations of the lower transverse beam.

5. The container of claim 3, wherein said diagonal struts are U-section beams which are open to the outside in said axial direction.

6. The container of claim 2, wherein each said saddle ring is secured to plane elements bridging the corners of the respective end frame.

7. The container of claim 2, wherein each said saddle ring is secured to said vertical supports of the respective end frame.

8. The container of claim 2, wherein each end ring is joined, via diagonally extending elements, directly to the corner fittings of the respective end frame.

9. The container of claim 2, wherein the tank is composed of a plurality of part-cylindrical shells, said end ring is shaped so as to follow a peripheral line that is radially inwardly of said knuckle zone of each bottom, and each saddle ring is shaped to follow the shape of the end ring.

10. The container of claim 1, wherein each said saddle structure includes a saddle ring which is a radially outwardly open U-section ring and has its radial flange facing the tank joined to a parallel flange of a fitting ring of L-shaped cross-section, the axially extending flange of said fitting ring being joined to the respective end ring.

11. The container of claim 10, including insulating members sandwiched between the facing parallel flanges of said saddle and fitting rings and between an axially extending web of said saddle ring and said end ring, said saddle fitting and end rings being detachably interconnected.

12. The container of claim 1, wherein each said saddle structure includes a saddle ring which is a radially inwardly open U-section partial ring secured to the lower half of the respective end frame, and wherein the respective end ring engages into said saddle partial ring with a radially outwardly extending profiled element. web of said saddle ring and said end ring, said saddle, fitting and end rings being detachably interconnected.

13. The container of claim 12, wherein said profiled element is a profiled ring welded to the respective end ring.

14. The container of claim 12, wherein the upper half of said profiled element is anchored to an upper location of the respective end frame or opposite to the respective saddle partial ring.

15. The container of claim 12, including an insulating member sandwiched between each said profiled element and the respective saddle partial ring.

16. The container of claim 1, wherein each said end ring has an L-shaped cross-section, with an axially extending flange welded to the respective tank end portion and a radially extending flange, and wherein each said saddle structure includes four corner elements, each of which has a first plane parallel and joined to said radially extending flange of said end ring and second and third planes extending perpendicularly to each other and to said first plane and being joined to respective parallel faces of said end frame vertical supports and transverse beams.

17. The container of claim 16, wherein each corner element has a reinforcing web welded to said first plane and extending radially from the respective end frame corner.

18. The container of claim 17, wherein said reinforcing web has its radially inner end welded to said end ring.

19. The container of claim 1, wherein the radially outer and inner edges of each end ring are welded to the respective tank end portion.

20. The container of claim 1, including a support ring of L-shaped cross-section, having a first flange welded to the respective tank end portion inside the respective end ring, and a second flange welded to the end ring.

21. The container of claim 1, including a support ring of L-shaped cross-section having a first flange welded to a cylindrical rim portion of the respective tank end portion adjacent the tank shell and a second flange welded to said end ring.

22. A freight container comprising:

(a) a cylindrical tank shell and tank end portions joined to the tank shell having a knuckle zone of a radius of curvature which is smaller than the radius of curvature of each tank end portion, (b) two end frames defining the overall dimensions of the container, each end frame having upper and lower transverse beams, vertical supports, and corner fittings, (c) means joining the tank shell and end portions to each end frame and including (c1) end rings welded to a part of the respective tank end portions surrounded by and in close proximity to said knuckle zone, and (c2) saddle structures each having a first flange joined to a portion of said end ring and a second flange extending substantially perpendicularly to said first flange and being joined to said respective end frame, and (d) support rings of L-shaped cross-section, each having a first flange welded to the respective tank end portions inside the respective end ring, and a second flange welded to the end ring.

* * * * *